US005860788A

United States Patent [19]

Sorensen

[11] Patent Number: 5,860,788

[45] Date of Patent: Jan. 19, 1999

[54] LOW DRAG FAN ASSEMBLY

[75] Inventor: Bradford T. Sorensen, Glendale, Calif.

[73] Assignee: Shell Electric Mfg. (Holdings) Co. Ltd., Hong Kong, Hong Kong

[21] Appl. No.: 663,714

[22] Filed: Jun. 14, 1996

[51] Int. Cl.[6] ..... F04D 29/38

[52] U.S. Cl. ..... 416/189; 416/5; 416/126; 416/130; 416/193 R; 416/170 R; 416/203; 416/223 R; 416/244 R

[58] Field of Search ..... 416/5, 126, 127, 416/130, 189, 192, 193 R, 223 R, 244 R, 170 R, 175, 203, DIG. 6; 415/77, 78, 79, 220, 223; 384/549; D23/377, 379, 385, 411, 413; 454/208, 338, 354

[56] References Cited

U.S. PATENT DOCUMENTS

| | | | |
|---|---|---|---|
| D. 112,847 | 1/1939 | Roffy . | |
| D. 136,162 | 8/1943 | Lee . | |
| D. 142,959 | 11/1945 | Lee . | |
| D. 173,436 | 11/1954 | Kline et al. . | |
| D. 297,761 | 9/1988 | Shiraki . | |
| D. 330,937 | 11/1992 | O'Connor . | |
| D. 340,514 | 10/1993 | Liao . | |
| D. 355,253 | 2/1995 | Jansen et al. . | |
| 551,196 | 12/1895 | Richards | 384/549 |
| 759,167 | 5/1904 | Eastwod | 416/DIG. 6 |
| 1,222,837 | 4/1917 | Winslow et al. . | |
| 1,462,151 | 7/1923 | Seymour | 416/126 |
| 1,699,201 | 1/1929 | Guth . | |
| 2,295,451 | 9/1942 | Davis, Jr. et al. | 454/354 |
| 2,366,142 | 12/1944 | Allen . | |
| 2,790,596 | 4/1957 | Stirling | 416/193 R |
| 3,069,135 | 12/1962 | Welsh . | |
| 3,603,700 | 9/1971 | Eskeli | 416/203 |
| 3,728,044 | 4/1973 | Fujita et al. . | |
| 4,020,565 | 5/1977 | Steffen | 416/DIG. 6 |
| 4,064,427 | 12/1977 | Hansen et al. . | |
| 4,684,817 | 8/1987 | Goldwater | 416/DIG. 6 |
| 4,750,863 | 6/1988 | Scoggins . | |
| 5,591,004 | 1/1997 | Aylor | 416/170 R |
| 5,632,599 | 5/1997 | Townsend | 416/DIG. 6 |

FOREIGN PATENT DOCUMENTS

| | | | |
|---|---|---|---|
| 391894 | 11/1908 | France | 416/189 |
| 860564 | 2/1961 | United Kingdom | 454/354 |

*Primary Examiner*—Christopher Verdier
*Attorney, Agent, or Firm*—Sheldon & Mak

[57] ABSTRACT

A fan assembly includes a circular first array of first fan blades; a first primary ring member supportively connecting inner extremities of the first blades about a fan axis, respective end extremities of at least a majority of the first blades defining inside and outside diameters of the array, the first blades being oriented for producing a primary axial fluid flow between the inside and outside diameters in response to rotation of the first ring member, the first ring member extending between the inside and outside diameters. A second primary ring member connects outer extremities of the first blades, the first blades in combination with the first ring member defining a generally circular opening about the fan axis. Optionally a circular second array of a plurality of second blades that are oriented for producing secondary axial fluid flow in an opposite direction relative to the primary axial fluid flow, a secondary ring connecting outer extremities of second blades, end extremities of at least a majority of the second blades defining an outside diameter of the second array. A plurality of spokes extend inwardly from the first primary ring member for rotatably supporting the first primary ring member, a hub connecting the spokes to a rotating element, the second blades also being held in fixed relation to the spokes, whereby, when the rotating element is being rotated for producing the primary axial flow, an unimpeded secondary axial flow is produced within the opening outside of the secondary ring.

20 Claims, 5 Drawing Sheets

LOW DRAG FAN ASSEMBLY

BACKGROUND

The present invention relates to fans such as ceiling fans and room fans for air circulation and/or ventilation within building structures and the like.

Ceiling fans for air circulation are well known, typically having four to six blade paddles that extend outwardly from a motor that is suspended below the ceiling of a room. The blade paddles are planar and extend to an outside diameter that is usually between four and five feet from proximate a centrally located motor that is relatively large, being typically 9 to 14 inches in diameter. As shown in FIGS. 1 and 2, conventional ceiling fans produce a generally torroidal flow pattern in which vertical flow goes in one direction near the center of the room, and in an opposite direction near the walls. Other ventilation fans of the prior art include units having a grille or bezel that clamps to a wall or ceiling surface about a duct opening. One such unit having an annular array of openings surrounding a lamp is shown in U.S. Design Pat. No. 340,514 to Liao. Other types of room fans are also well known, including table fans and floor fans for producing predominately horizontal circulation.

The fans of the prior art are not entirely satisfactory in that they exhibit one or more of the following disadvantages:

1. They are ineffective in providing a desired amount and distribution of circulation;
2. They are inefficient in that they exhibit excessive aerodynamic drag for a given amount of circulation due to the combination of a wide variation in blade speed from the tip toward the motor, and the motor or other bulky central structure blocking axial flow;
3. They are dangerous in that accidental contact with moving parts is likely to produce serious injury; and
4. They are excessively noisy.

Thus there is a need for a fan that overcomes the disadvantages of the prior art.

SUMMARY

The present invention meets this need by providing a fan assembly that is effective, highly efficient, safe, and quiet. In one aspect of the invention, the fan assembly includes a circular array of fan blade members; a ring member supportively connecting the blade members about a fan axis, respective end extremities of at least a majority of the blade members defining an inside diameter D1 and an outside diameter D2 of the array, the blade members being oriented for producing a primary axial fluid flow between the diameters D1 and D2 in response to rotation of the ring member; the blade members in combination with the ring member defining a generally circular opening about the fan axis, the opening having a diameter D0 being not less than 90 percent of D1; and means for rotatably supporting the ring member on the fan axis, whereby, when the ring member is being rotated for producing the primary axial flow, an unimpeded secondary axial flow is produced within the opening. The diameter D1 is not less than 50 percent of D2, the blade members having a combined projected area between the diameters D1 and D2 in the plane of the diameter D2 and an associated average projected area density $\delta$, at least an annular margin portion of the opening outside 75 percent of D0 being obstructed at an average projected area density $\gamma$ not more than 5 percent of the density $\delta$.

The ring member can extend between the diameters D0 and D1. The means for rotatably supporting the ring member can include a plurality of spoke members extending inwardly from the ring member, and hub means for connecting the spoke members to a rotating element. The fan assembly can further include a motor having a rotatably driven shaft, the hub means including a hub member adapted for fixably connecting the driven shaft, whereby the ring member rotates in unison with the driven shaft.

The blade members can be first blade members in a first array, the assembly further including a plurality of second blade members in a circular second array; means for rotatably supporting the second array on the fan axis; and means for rotating the second array about the fan axis when the ring member is being rotated. End extremities of at least a majority of the second blade members can define an outside diameter D3 of the second array, the second blade members being oriented for producing a secondary axial fluid flow within the diameter D3 in response to rotation of the ring member, D3 being not more than 75 percent of D1. The fan assembly can include means for holding the second blade members in fixed relation to the spoke members.

Preferably the second blade members are oriented for producing the secondary axial fluid flow in an opposite direction relative to the primary axial fluid flow. The fan assembly can further include means for driving the second array at a second angular velocity when the first array is being driven at a first angular velocity, the second angular velocity being greater than the first angular velocity. The ring member can be a primary ring member, the assembly further including a secondary ring connecting outer extremities of the second blade members.

The ring member can be a first ring member connecting inner extremities of the blade members, the assembly further including a second ring member connecting outer extremities of the blade members. The means for rotatably supporting the ring member can include a rotatably supported guide roller that is in rolling engagement with the ring member. The guide roller can be one of a plurality of guide rollers. The assembly can include at least three of the guide rollers, each adjacent pair of the guide rollers contacting the ring member at spaced locations subtending an angle less than 180° about the fan axis. The assembly can further include a motor having a rotatably driven shaft, and means for coupling the guide roller to the ring member for rotation thereof. The means for coupling can include the guide roller being driven by the driven shaft. The means for coupling can include a drive roller engaging the ring member, the drive roller being coupled to the driven shaft.

DRAWINGS

These and other features, aspects, and advantages of the present invention will become better understood with reference to the following description, appended claims, and accompanying drawings, where:

DESCRIPTION

Figure 3:
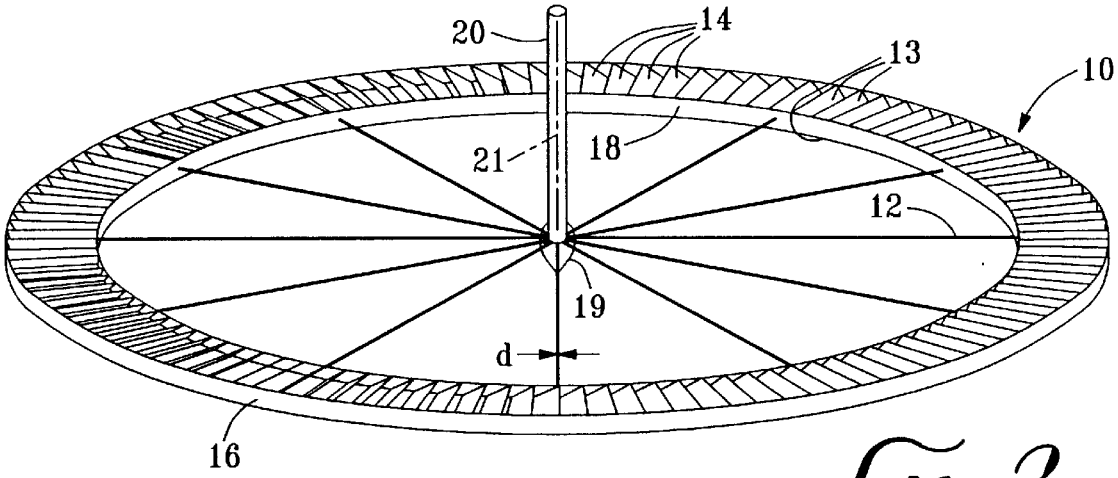
FIG. 3 is an elevational perspective view of a fan rotor assembly according to the present invention.
Figure 4:
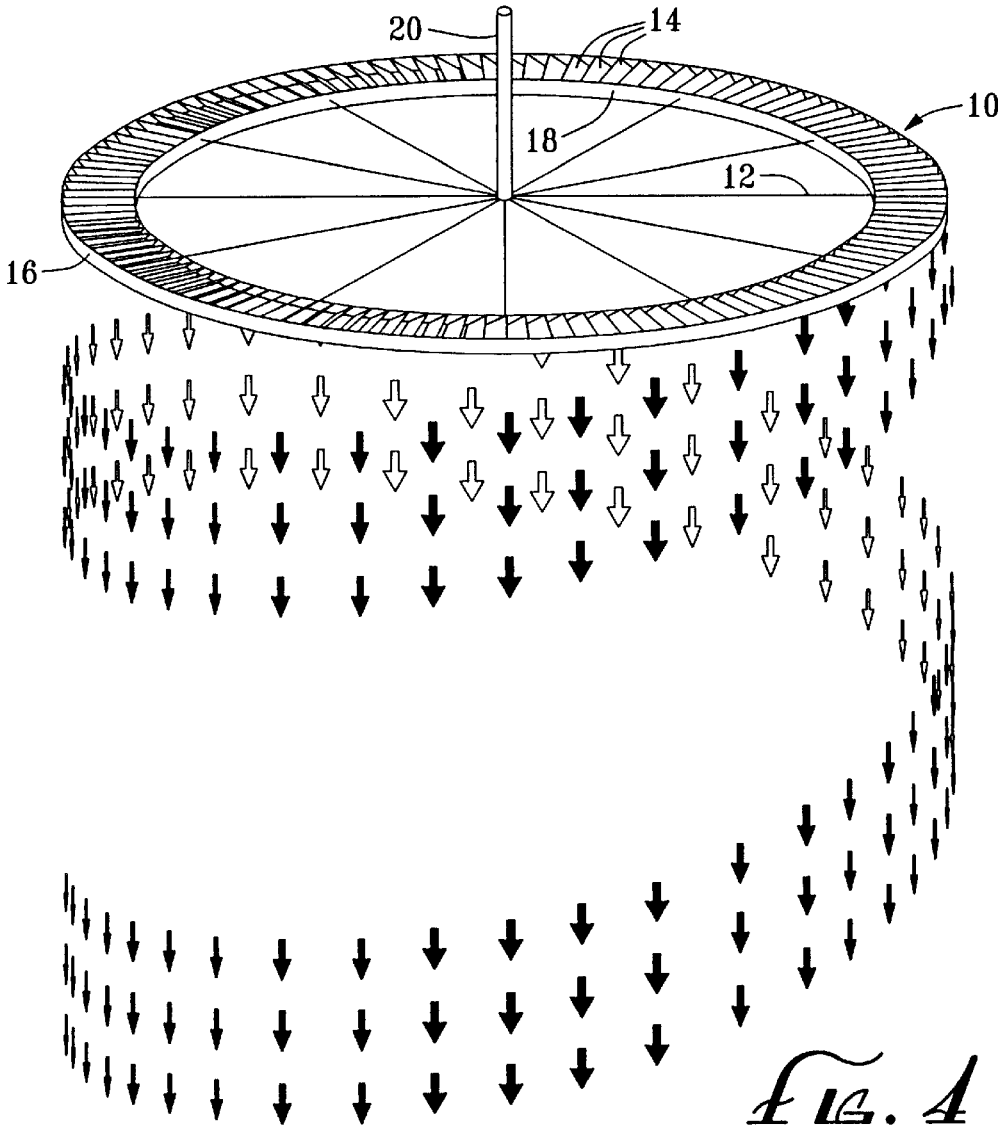
FIG. 4 is a perspective view showing a pattern of air circulation being produced by the fan rotor assembly of FIG. 3.

The present invention is directed to a fan assembly that is particularly suitable for efficiently ventilating and circulating room air. With reference to FIGS. 3–8 of the drawings, a fan apparatus 10 has a plurality of thin radial spokes 12 or other means for rotatably supporting a primary fan rotor 13 having a multiplicity of generally radially extending blade members 14, the blade members 14 being oriented for producing axial flow in response to rotation thereof, the apparatus 10 providing substantially unblocked axial flow in a central region surrounded by the blade members 14. In an exemplary configuration of the apparatus 10, respective ends of the blade members 14 are connected by an outer ring member 16 and an inner ring member 18, the primary fan rotor 13 including the blade members 14 and the ring members 16 and 18. It will be understood that only one ring member might be used for supportively connecting the blade members 14, such ring member being locatable at either end of the blade members, or at an intermediate location. In the above-described exemplary configuration, outer extremities of the spokes 12 are connected to circumferentially spaced locations along the inner ring member 18, opposite extremities of the spokes 12 being rigidly connected by a hub 19 to a central shaft 20, the shaft 20 being rotatable on a shaft axis 21. FIG. 4 shows a pattern of axial air flow being generated by the blade members 14 being rotated about the shaft 20, the blade members 14 being oriented for producing downward flow in response to rotation in a counterclockwise direction as viewed from above.

Figure 5:
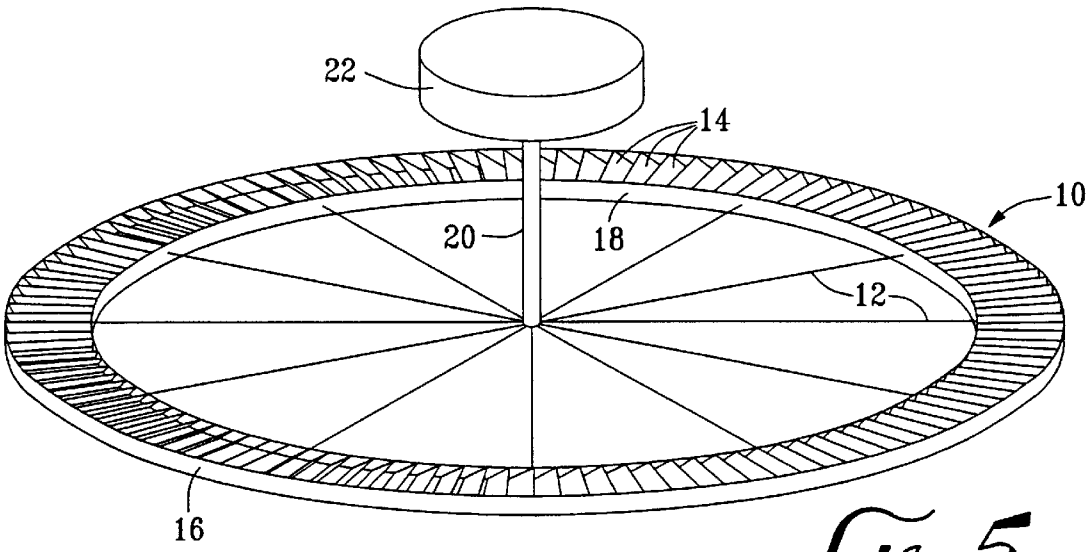
FIG. 5 is a perspective view of the fan rotor assembly of FIG. 3 in combination with a driving motor.
Figure 6:
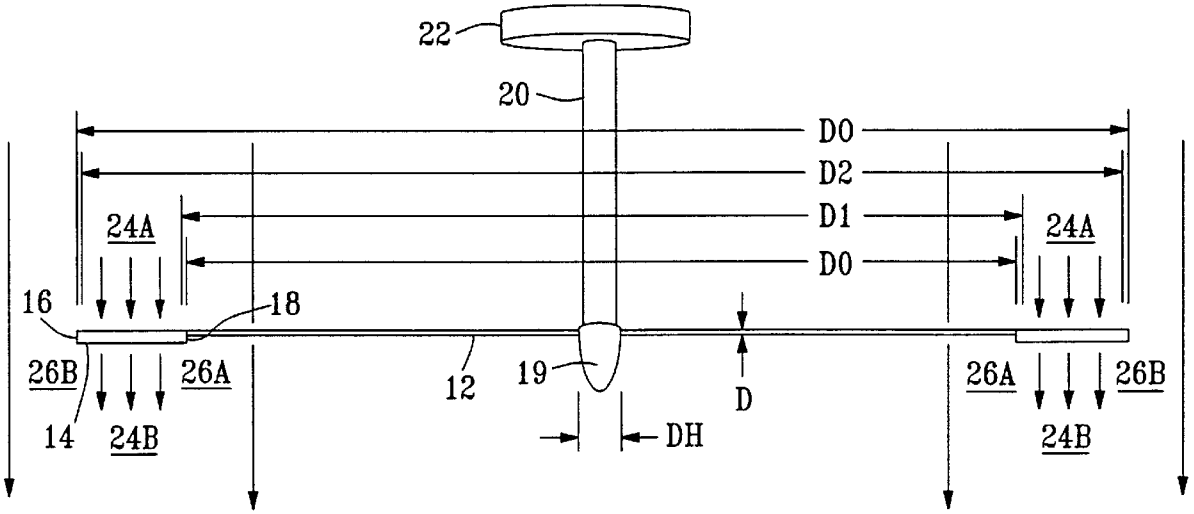
FIG. 6 is a sectional diagrammic view of the fan combination of FIG. 5, showing regions of axial circulation.

As shown in FIG. 5, the shaft 20 can be powered by a conventional fan motor 22, the motor 22 being preferably axially displaced a sufficient distance from the inner ring 18 that the axial flow within the ring 18 is substantially uneffected by the physical presence of the motor 22. As further shown in FIG. 6, in addition to respective intake and exhaust regions 24A and 24B that extend from opposite surfaces of the blade members 14, there are respective inside and outside entrainment regions 26A and 26B that extend adjacent thereto, the inside ring member 18 separating the inside entrainment region 26A from the intake and exhaust regions 24A and 24B, the outside ring member 16 similarly separating the outside entrainment region 26B. As further shown in FIG. 6, the intake and exhaust regions 24A and 24B have an inside diameter D1 being an outside diameter of the inside ring member 18, and an outside diameter D2 being an inside diameter of the outside ring member 16. The inside entrainment region 26A has an outside diameter D0 being an inside diameter of the inside ring member 18 and an inside diameter being a diameter DH of the hub member 19; and the outside entrainment region 26B has an inside diameter D0 being an outside diameter of the outside ring member 16. The entrainment regions 26A and 26B extend at diminishing strength from the respective ring members 18 and 16 as further described below. According to the present invention, the inside diameter D0 of the inner ring member 18 is not less than 90 percent of the outside diameter D1 of the member 18, and is at least 50 percent of the outside diameter D2 for facilitating substantial axial flow within the inner ring member 18 with minimal associated aerodynamic drag. Preferably the inside diameter D0 is at least approximately 99 percent of D1 and 75 percent of D2, being more preferably approximately 80 percent of D2. It is contemplated that the ring members 16 and 18 be formed of sheet material having a thickness of 0.1 inch or less in implementations wherein D0 is 30 inches or more, for minimal resistance to axial flow. Thus D0 is typically more than 99 percent of D1, and D2 is an even higher percentage of D0.

Preferably the spokes 12 number far fewer than the blade members 14. For example, the exemplary configuration of the apparatus 10 as shown in FIGS. 3–5 includes a number NB being 120 of the blade members 14, yet a number NS of the spokes 12 is only 12. Also, the spokes 12 are preferably each formed with a low-drag profile respecting local air flow within the inside ring member 18. In this aspect, a low drag profile respecting a range of relative air flow directions along the spokes 12 is achieved using a small round or rounded cross-sectional shape of each spoke 12. Thus the spokes 12 are shown in FIG. 3 as having a cross-sectional diameter d in the plane of the inside ring member 18. Alternatively, the spokes 12 can have an aerodynamic bladed shape that incorporates a twist for approximate alignment with local relative air flow directions. However, it is preferred that the spokes 12 not be optimized for "lift", at least in applications producing significant variations in the relative flow direction at fixed locations on the spokes 12, because lift is more efficiently obtained at the higher peripheral speeds that are inherently present outside of the inner ring member 18. A further consideration is that a preponderance of volumetric axial flow within the inner ring member 18 normally occurs in an annular region outside 50 percent of the inside diameter D0. More particularly, if the axial flow velocity is assumed to be uniformly distributed inside of the inner ring member, half of the flow volume is located outside of a diameter that is 70.7 percent of D0. As indicated above, however, the flow density of the inside entrainment region 26A is highest proximate the inside ring member 18. Consequently, at least an annular margin portion between 75 and 100 percent of the diameter D0 should be minimally resistant to axial flow. Accordingly, the present invention provides that, in the annular region extending between 75 percent and 100 percent of the inside diameter D0, there is an average projected area density $\gamma$ of the fan apparatus 10 that is not more than 5 percent of a corresponding average projected area density $\delta$ of the blade members 14 between the diameters D1 and D2. For example, the blade members 14 in the configuration of FIGS. 3–5 cover approximately 100 percent of the area between the diameters D1 and D2 as shown by an approximate axial alignment between leading and trailing edges of adjacent ones of the blade members 14 ($\delta$=1.0). The area density $\gamma$, being the projected area of the spokes 12 between 0.75 D0 and 1.0 D0 divided by the total area between the same diameters, is $$\gamma \cong 2*NS*D0(1.0-0.75)d/\pi(D0^2-(0.75D0)^2)$$
$$= 0.5*NS*D0d/7*\pi D0^2/16 = 8*NS*d/7\pi D0$$
$$= 0.364*NS*d/D0.$$

For the case of NS=12, γ=4.36 d/D0. It is preferred that γ be less than 0.05, or more specifically less than 5 percent of the projected density δ of the blade members 14. In a practical example, the diameter D0 is 36 inches. Thus γ=0.121 d, and a small but sufficient value of d for rotational support of the inner ring member 18 is 0.025 inch, γ being only approximately 0.03. This is only approximately 3 percent of the blade density δ in the above-described exemplary blade configuration of FIGS. 3–5.

Figure 1:
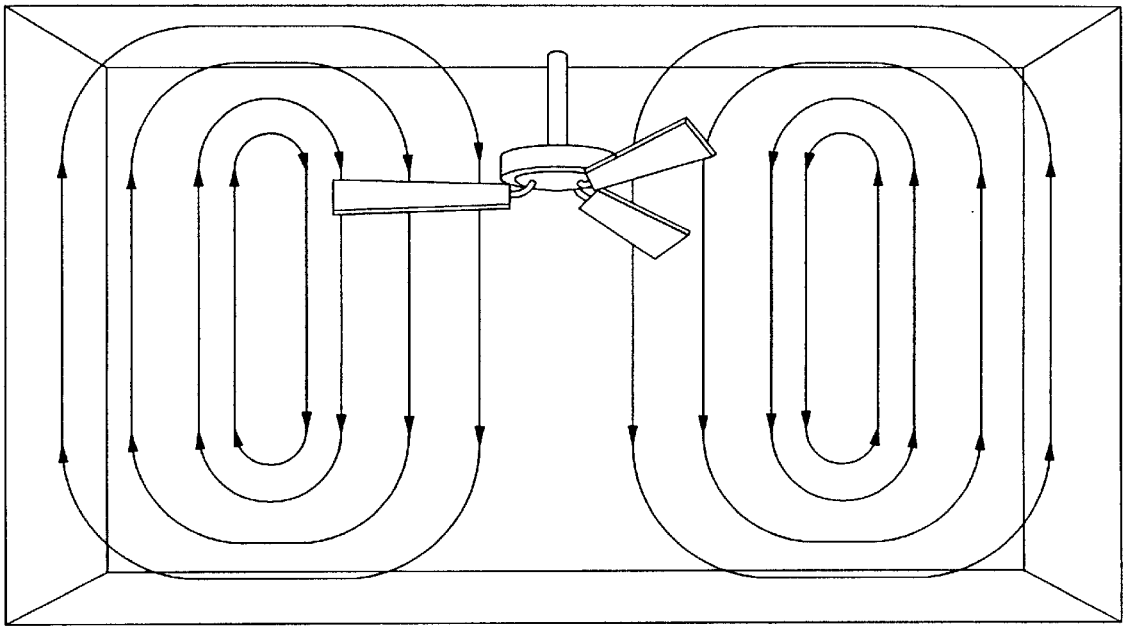
FIG. 1 PRIOR ART
FIG. 1 is an elevational perspective view of a prior art fan assembly as installed in a room, showing an associated toroidal airflow pattern.
Figure 2:
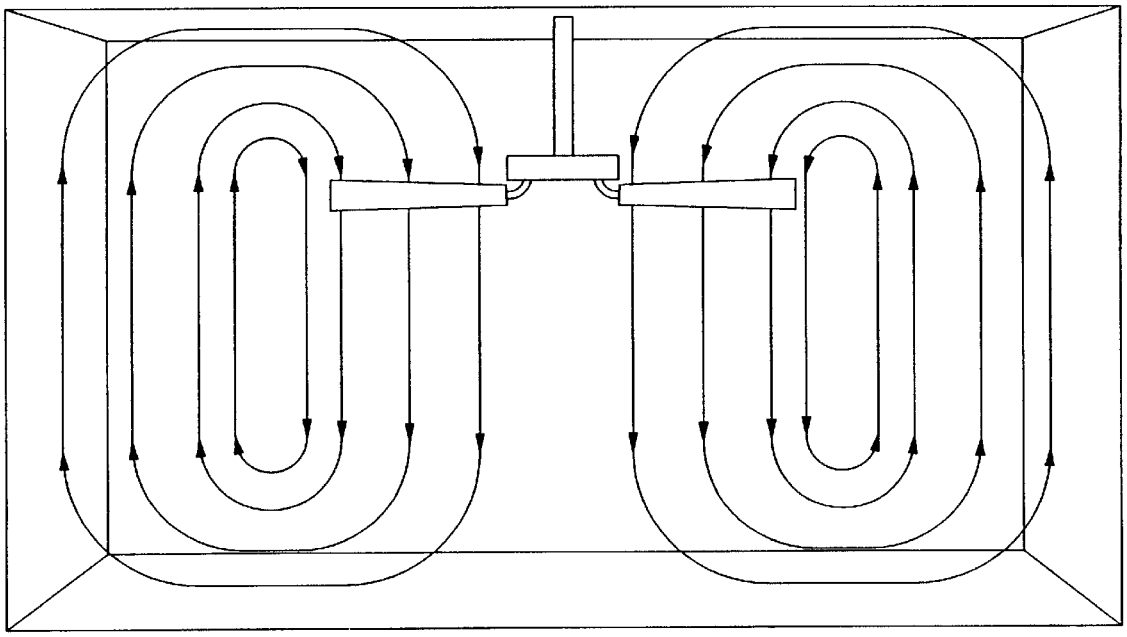
FIG. 2 PRIOR ART
FIG. 2 is a pictorial diagrammic view showing the prior art fan assembly and air flow pattern of FIG. 1.
Figure 7:
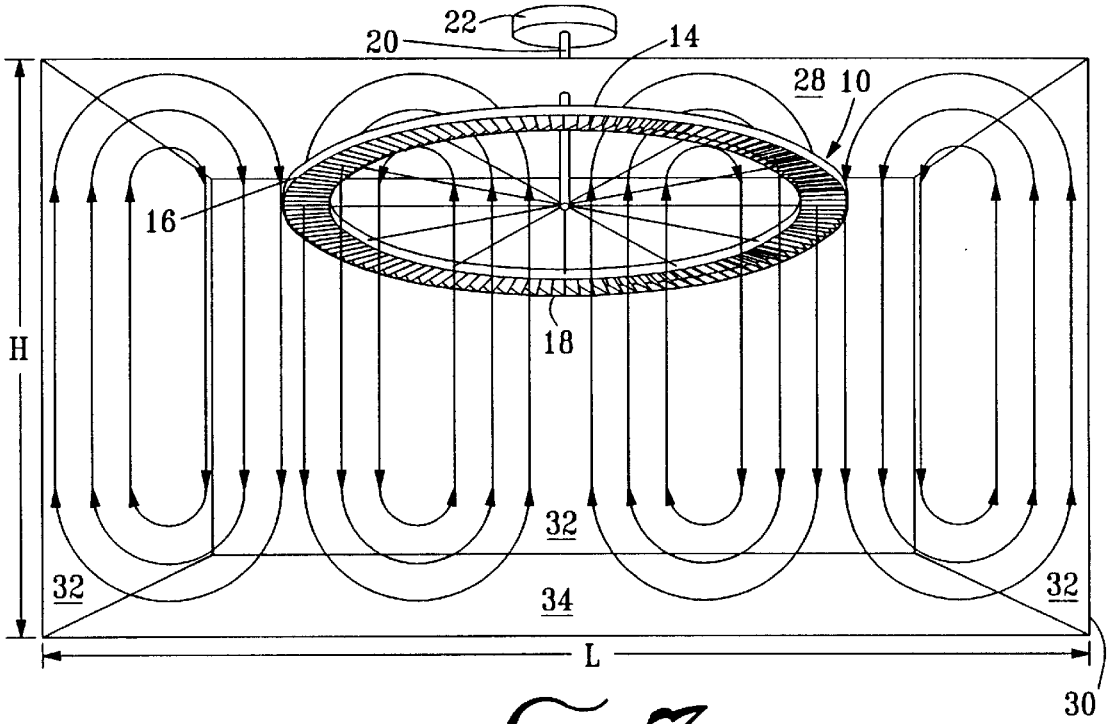
FIG. 7 is an elevational perspective view of the fan combination of FIG. 5 as installed in a room, showing an associated double concentric toroidal airflow pattern.
Figure 8:
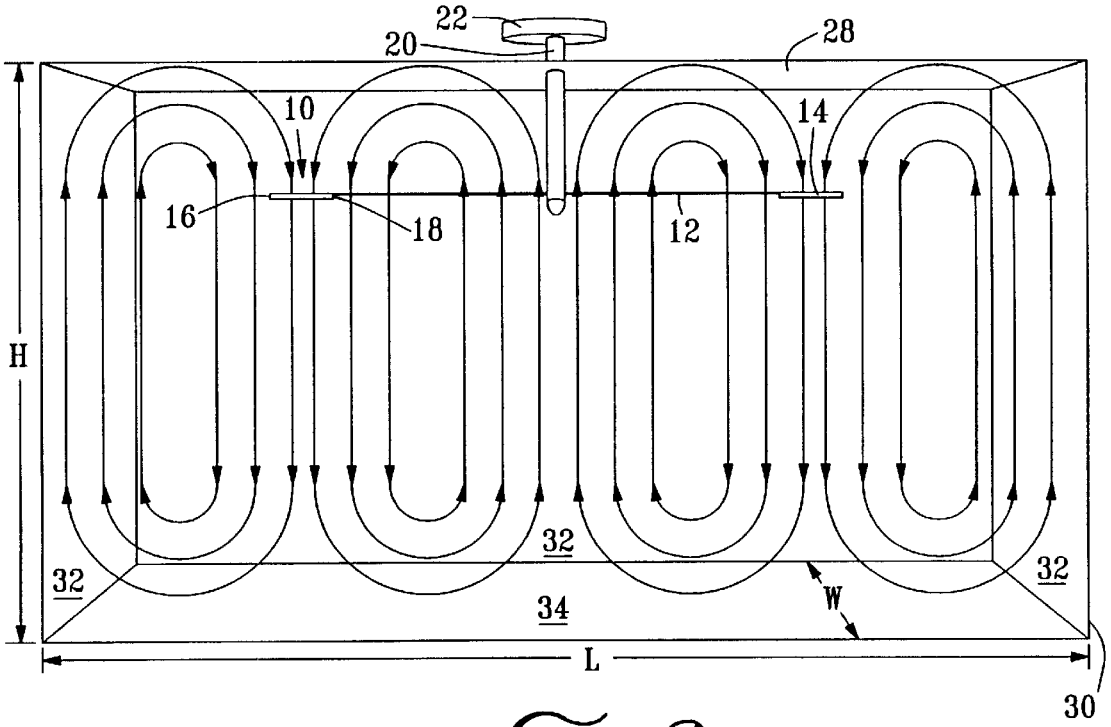
FIG. 8 is a pictorial diagrammic view showing the fan combination and air flow pattern of FIG. 7.

FIGS. 7 and 8 show the apparatus 10 including the motor 22 installed approximately centrally supported relative to a ceiling 28 of a building room structure 30, the structure 30 also having inwardly facing walls 32 and a floor 34. The walls 32 extend vertically between perimeter segments of the ceiling 28 and the floor 34, a near side wall being not shown for clarity. The room 30 has a length L, a width W, and a height H. In the configuration of FIGS. 7 and 8, the apparatus 10 produces air circulation in a "double toroid" pattern, when an average of the diameters D1 and D2 is roughly half of the length L and the width W in combination with the diameter D1 being not less than approximately 75 percent of the diameter D2. This double toroid circulation pattern is advantageously more uniform than the simple toroidal pattern that is characteristic of many prior art room fan installations as described above in connection with FIGS. 1 and 2. Thus the present invention provides a more even distribution of temperature and flow velocity in appropriate room installations. Also, the blade members 14 can be located in closer proximity to the ceiling 28 without restricting circulation in that vertical return flow can extend within the opening formed by the inner ring member 18, as well as outside of the outer ring member 16. It will also be understood that multiples of the fan apparatus 10 can be employed in larger rooms with counterparts of the double toroid pattern being produced when a horizontal spacing of the shafts 20 is approximately double the average of the diameters D0 and D1.

Suitable materials for the apparatus 10 include metals such as aluminum and steel, as well as plastics. In fact, it is contemplated that the assembly of the ring members 16 and 18 with the blade members 14 be molded integrally, in one piece or in segments. The integral molding can also include the spokes 12 and the hub 19. Alternatively, the spokes 12 can be formed of a different, stiffer material such as a carbon filament/polymer composite having bonded connections to the inner ring member 18 and to the hub 19.

Figure 9:
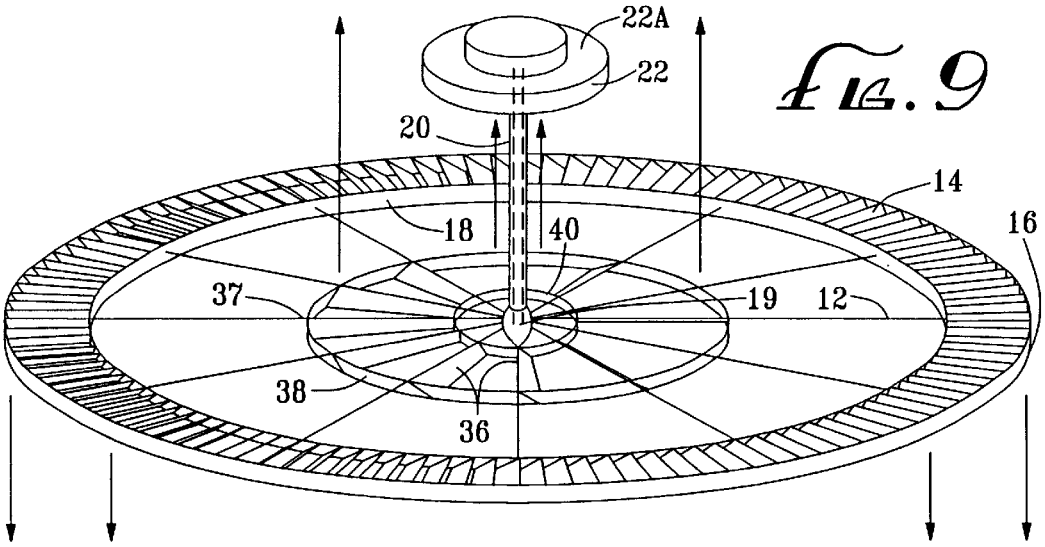
FIG. 9 is an elevational perspective view showing a an alternative configuration of the fan rotor of FIG. 3.
Figure 10:
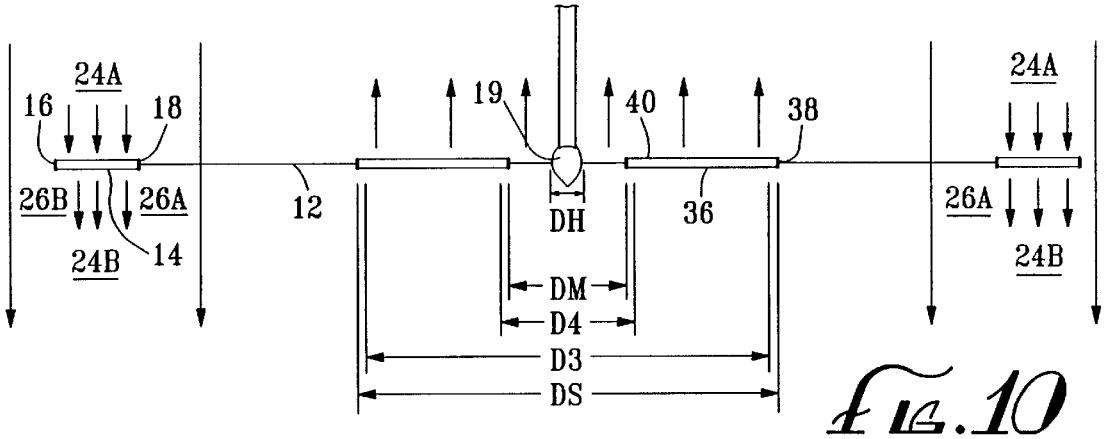
FIG. 10 is a diagrammic view as in FIG. 6, showing the alternative configuration of FIG. 9.

With further reference to FIGS. 9 and 10, an alternative configuration of the fan apparatus 10 includes an array of secondary blade members 36 that are generally coplanar with the blade members 14 but spaced within the inner ring 18, the blade members 14 being also designated primary blade members. As best shown in FIG. 10, an exemplary implementation of this configuration has the secondary blade members 36 in a secondary fan rotor 37, the blade members 36 extending radially inwardly from a secondary ring member 38 (having an inside diameter D3) to a minor ring member 40 (having an outside diameter D4). The secondary ring member 38 has an outside diameter DS, and the minor ring member 19 has an inside diameter DM. Typically, D3 is approximately half of D0, and the minor ring member 40 can be combined with the hub member 19, in which case the diameter D4 is only about 10 percent of D3. In the exemplary configuration of FIGS. 9 and 10, the minor ring member 19 is spaced from the hub member 19, in which case the diameter D4 can be from about 35 percent to about 75 percent of the diameter D3. It is preferred, especially in cases of the diameter D4 being less than about 60 percent of the diameter D3, that the secondary blade members 36 be formed with radially progressively changing pitch in a conventional manner for a desired combination of axial lift and low rotational drag.

Figure 11:
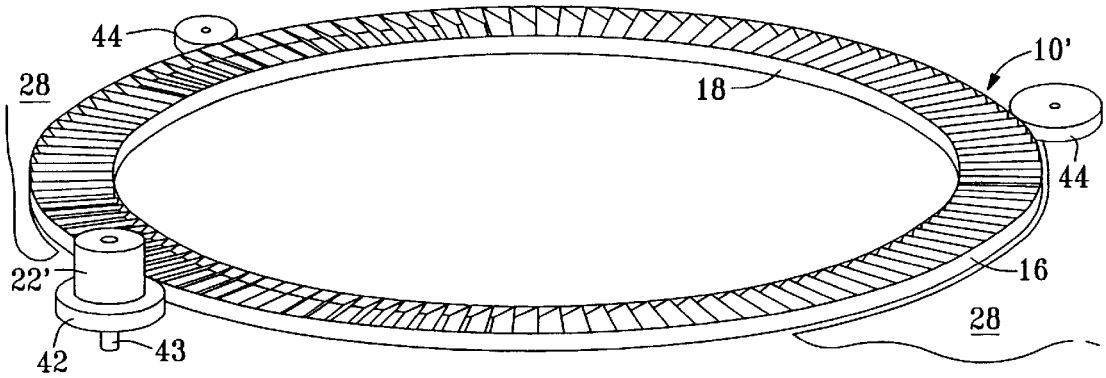
FIG. 11 is an elevational perspective view showing an alternative configuration of the fan combination of FIG. 5.

With further reference to FIG. 11, an alternative configuration of the fan apparatus, designated 10', has a counterpart of the motor, designated 22', positioned for driving the outer ring member 16 by means of a drive roller or wheel 42, the wheel 42 being mounted on a driven shaft 43 of the motor 22'. One or more idler wheels 44 also engage the ring member 16, the combination of the wheels 42 and 44 providing rotational support for the outer ring member 16. It will be understood that the wheels 42 and 44 are themselves rotationally supported in any suitable manner from stationary structure, and that the outer ring member 16 can be oriented in a vertical plane as well as having the horizontal orientation of FIG. 11. Also, the outer ring member 16 can be located flush with a wall or ceiling opening, the wheels 42 and 44 being rotationally mounted relative to the wall or ceiling. Rotational support by the wheels 42 and 44 can be by flange portions of the wheels engaging corresponding edge surfaces of the outer ring member 16. Further, the drive wheel 42 and the outer ring member 16 can be adapted for geared engagement. Moreover, a flexible belt or chain can be interposed between the drive wheel 42 and the outer ring member 16.

The fan apparatus of the present invention is particularly advantageous in that the circumferential velocity at points along the blade members 14 is nearly uniform when the diameter D1 is a large portion of the diameter D2. In some applications this provides significantly reduced noise and power consumption at a given volumetric flow; in other applications there is significantly greater flow at no increase in power. The apparatus 10 also provides significantly improved uniformity of circulation in many room environments. An important feature of the fan apparatus 10' in the configuration of FIG. 11 is that the space within the inner ring member 18 is completely unobstructed.

Although the present invention has been described in considerable detail with reference to certain preferred versions thereof, other versions are possible. For example, the spokes 12 can slope outwardly and slightly downwardly for utilizing tensile strength thereof in supporting the inner ring member 18. Further, the secondary fan rotor 37 can be driven at a different (higher) rotational speed than the primary blade members 14 for increased efficiency, by means such as a geared coupling to the shaft 20 or a separate counterpart 22A of the motor 22 as shown in FIG. 9. Moreover, the direction of rotation of the secondary fan rotor 37 can be controlled independently of the primary blade members 14. Therefore, the spirit and scope of the appended claims should not necessarily be limited to the description of the preferred versions contained herein.

What is claimed is:

1. A fan assembly in combination with a room structure having walls vertically extending between a floor and a ceiling, the fan assembly being supported by the ceiling in spaced relation to the walls and comprising:

(a) a circular array of fan blade members;

(b) a ring member supportively connecting the blade members about a fan axis, respective end extremities of at least a majority of the blade members defining an inside diameter D1 and an outside diameter D2 of the array, the blade members being oriented for producing a primary axial fluid flow between the diameters D1 and D2 in response to rotation of the ring member, D1 being not less than 50 percent of D2, the blade members having a combined projected area between the diameters D1 and D2 in the plane of the diameter D2 and an associated average projected area density δ;

(c) the blade members in combination with the ring member defining a generally circular opening about the fan axis, the opening having a diameter D0 being not less than 90 percent of D1, at least an annular margin portion of the opening outside 75 percent of D0 being obstructed at an average projected area density γ not more than 5 percent of the density δ; and (d) means for rotatably supporting the ring member on the fan axis, whereby, when the ring member is being rotated for producing the primary axial flow, a secondary axial flow is produced within the opening, the secondary axial flow being unimpeded by blade members, a double toroid circulation pattern being produced in the room.

2. The fan assembly of claim 1, wherein the ring member extends between the diameters D0 and D1.

3. The fan assembly of claim 2, wherein the means for rotatably supporting the ring member comprises a plurality of spoke members extending inwardly from the ring member, and hub means for connecting the spoke members to a rotating element.

4. The fan assembly of claim 3, further comprising a motor having a rotatably driven shaft, and the hub means comprises a hub member adapted for fixably connecting the driven shaft, whereby the ring member rotates in unison with the driven shaft.

5. The fan assembly of claim 3, wherein the blade members are first blade members in a first array, the assembly further comprising a plurality of second blade members in a circular second array; means for rotatably supporting the second array on the fan axis; and means for rotating the second array about the fan axis when the ring member is being rotated.

6. The fan assembly of claim 1, wherein the ring member is a first ring member connecting inner extremities of the blade members, the assembly further comprising a second ring member connecting outer extremities of the blade members.

7. A fan assembly comprising:

(a) a circular first array of first fan blade members;

(b) a ring member supportively connecting the first blade members about a fan axis, respective end extremities of at least a majority of the first blade members defining an inside diameter D1 and an outside diameter D2 of the first array, the first blade members being oriented for producing a primary axial fluid flow between the diameters D1 and D2 in response to rotation of the ring member, D1 being not less than 50 percent of D2, the first blade members having a combined projected area between the diameters D1 and D2 in the plane of the diameter D2 and an associated average projected area density δ;

(c) the first blade members in combination with the ring member defining a generally circular opening about the fan axis, the opening having a diameter D0 being not less than 90 percent of D1, at least an annular margin portion of the opening outside 75 percent of D0 being obstructed at an average projected area density γ not more than 5 percent of the density δ;

(d) means for rotatable supporting the ring member on the fan axis;

(e) a plurality of second blade members in a circular second array;

(f) means for rotatable supporting the second array on the fan axis; and (g) means for rotating the second array about the fan axis when the ring member is being rotated, wherein outer extremities of at least a majority of the second blade members define an outside diameter D3 of the second array, the second blade members being oriented for producing a secondary axial fluid flow within the diameter D3 in response to rotation of the ring member, D3 being not more than 75 percent of D1.

8. The fan assembly of claim 7, comprising means for holding the second blade members in fixed relation to the spoke members.

9. The fan assembly of claim 8, wherein the second blade members are oriented for producing the secondary axial fluid flow in an opposite direction relative to the primary axial fluid flow.

10. The fan assembly of claim 7, further comprising means for driving the second array at a second angular velocity when the first array is being driven at a first angular velocity, the second angular velocity being greater than the first angular velocity.

11. The fan assembly of claim 7, wherein the ring member is a primary ring member, the assembly further comprising a secondary ring connecting the outer extremities of the second blade members.

12. The fan assembly of claim 7, in combination with a room structure having walls vertically extending between a floor and a ceiling, the fan assembly being supported by the ceiling in spaced relation to the walls, a double toroid circulation pattern being produced in the room when the ring member is rotated about the fan axis.

13. A fan assembly, comprising:

(a) a circular array of fan blade members;

(b) a ring member supportively connecting the blade members about a fan axis, respective end extremities of at least a majority of the blade members defining an inside diameter D1 and an outside diameter D2 of the array, the blade members being oriented for producing a primary axial fluid flow between the diameters D1 and D2 in response to rotation of the ring member, D1 being not less than 50 percent of D2;

(c) the blade members in combination with the ring member defining a generally circular opening about the fan axis, the opening being unobstructed and having a diameter D0 being not less than 90 percent of D1; and (d) means for rotatably supporting the ring member on the fan axis, comprising a rotatably supported guide roller, the guide roller being in rolling engagement with the ring member, whereby, when the ring member is being rotated for producing the primary axial flow, an unobstructed secondary axial flow is produced within the opening.

14. The fan assembly of claim 13, wherein the guide roller is one of a plurality of guide rollers.

15. The fan assembly of claim 14, comprising at least three of the guide rollers, each adjacent pair of the guide rollers contacting the ring member at spaced locations subtending an angle less than 180° about the fan axis.

16. The fan assembly of claim 13, further comprising a motor having a rotatably driven shaft, and means for coupling the guide roller to the ring member for rotation thereof.

17. The fan assembly of claim 16, wherein the means for coupling comprises the guide roller being driven by the driven shaft.

18. The fan assembly of claim 16, wherein the means for coupling comprises a drive roller engaging the ring member, the drive roller being coupled to the driven shaft.

19. The fan assembly of claim 13, in combination with a room structure having a wall and a ceiling, the ring member being located substantially flush with one of the wall and the ceiling, the opening extending through the one of the wall and the ceiling.

20. A fan assembly in combination with a room structure having walls vertically extending between a floor and a ceiling, the fan assembly being supported by the ceiling in spaced relation to the walls and comprising:

(a) a circular first array of first fan blade members;

(b) a first primary ring member supportively connecting inner extremities of the first blade members about a fan axis, respective end extremities of at least a majority of the first blade members defining an inside diameter D1 and an outside diameter D2 of the array, the first blade members being oriented for producing a primary axial fluid flow between the diameters D1 and D2 in response to rotation of the first ring member, D1 being not less than 50 percent of D2, the first blade members having a combined projected area between the diameters D1 and D2 in the plane of the diameter D2 and an associated average projected area density $\delta$, the first ring member extending between the diameters D0 and D1;

(c) a second primary ring member connecting outer extremities of the first blade members;

(d) the first blade members in combination with the first ring member defining a generally circular opening about the fan axis, the opening having a diameter D0 being not less than 90 percent of D1, at least an annular margin portion of the opening outside 75 percent of D0 being obstructed at an average projected area density $\gamma$ not more than 5 percent of the density $\delta$;

(e) a circular second array of a plurality of second blade members, the second blade members being oriented for producing secondary axial fluid flow in an opposite direction relative to the primary axial fluid flow;

(f) a secondary ring connecting outer extremities of second blade members, the outer extremities of at least a majority of the second blade members defining an outside diameter D3 of the second array, D3 being not more than 75 percent of D1;

(g) a plurality of spoke members extending inwardly from the first primary ring member for rotatably supporting the first primary ring member;

(h) hub means for connecting the spoke members to a rotating element, the second blade members also being held in fixed relation to the spoke members, whereby, when the rotating element is being rotated for producing the primary axial flow, a secondary axial flow is produced within the opening outside of the secondary ring, the secondary axial flow within the margin portion being unimpeded by blade members, a double toroid circulation pattern being produced in the room.

* * * * *